US009620067B2

(12) United States Patent
Harrington et al.

(10) Patent No.: US 9,620,067 B2
(45) Date of Patent: Apr. 11, 2017

(54) METHODS FOR DRIVING ELECTRO-OPTIC DISPLAYS

(71) Applicant: E Ink Corporation, Billerica, MA (US)

(72) Inventors: Demetrious Mark Harrington, Dartmouth, MA (US); Theodore A. Sjodin, Lexington, MA (US); Robert W. Zehner, Los Gatos, CA (US); Timothy J. O'Malley, Westford, MA (US); Benjamin Harris Paletsky, Morris, CT (US)

(73) Assignee: E Ink Corporation, Billerica, MA (US)

( * ) Notice: Subject to any disclaimer, the term of this patent is extended or adjusted under 35 U.S.C. 154(b) by 0 days.

(21) Appl. No.: 14/949,134

(22) Filed: Nov. 23, 2015

(65) Prior Publication Data

US 2016/0078820 A1 Mar. 17, 2016

Related U.S. Application Data

(60) Division of application No. 13/083,637, filed on Apr. 11, 2011, now Pat. No. 9,230,492, and a (Continued)

(51) Int. Cl.
*G09G 3/34* (2006.01)
*G09G 3/20* (2006.01)

(52) U.S. Cl.
CPC ..... *G09G 3/344* (2013.01); *G09G 3/2022* (2013.01); *G09G 2310/063* (2013.01); (Continued)

(58) Field of Classification Search
CPC ..... G09G 3/344; G02F 1/167; G02F 2001/1672–2001/1678
(Continued)

(56) References Cited

U.S. PATENT DOCUMENTS 3,668,106 A 6/1972 Ota
3,756,693 A 9/1973 Ota
(Continued)

FOREIGN PATENT DOCUMENTS

DE 2523763 2/1975
EP 0186519 7/1986
(Continued)

OTHER PUBLICATIONS

Wood, D., "An Electrochromic Renaissance?" Information Display, 18(3), 24 (Mar. 2002) Mar. 1, 2002.
(Continued)

*Primary Examiner* — Stephen Sherman
(74) *Attorney, Agent, or Firm* — Zhen Bao

(57) ABSTRACT

An electro-optic display uses first and second drive schemes differing from each other, for example a slow gray scale drive scheme and a fast monochrome drive scheme. The display is first driven to a pre-determined transition image using the first drive scheme, then driven to a second image, different from the transition image, using the second drive scheme. The display is thereafter driven to the same transition image using the second drive scheme; and from thence to a third image, different from both the transition image and the second image, using the first drive scheme.

14 Claims, 3 Drawing Sheets

Related U.S. Application Data continuation-in-part of application No. 12/411,643, filed on Mar. 26, 2009, now Pat. No. 9,412,314, which is a division of application No. 10/879,335, filed on Jun. 29, 2004, now Pat. No. 7,528,822, which is a continuation-in-part of application No. 10/814,205, filed on Mar. 31, 2004, now Pat. No. 7,119,772.

(60) Provisional application No. 61/322,355, filed on Apr. 9, 2010, provisional application No. 60/481,040, filed on Jun. 30, 2003, provisional application No. 60/481,053, filed on Jul. 2, 2003, provisional application No. 60/481,405, filed on Sep. 22, 2003, provisional application No. 60/320,070, filed on Mar. 31, 2003, provisional application No. 60/320,207, filed on May 5, 2003, provisional application No. 60/481,669, filed on Nov. 19, 2003, provisional application No. 60/481,675, filed on Nov. 20, 2003, provisional application No. 60/557,094, filed on Mar. 26, 2004.

(52) U.S. Cl.
CPC ..... *G09G 2320/0204* (2013.01); *G09G 2320/0209* (2013.01); *G09G 2320/0257* (2013.01)

(58) Field of Classification Search
USPC ..... 345/107, 96, 204, 690
See application file for complete search history.

(56) References Cited

U.S. PATENT DOCUMENTS 3,767,392 A 10/1973 Ota
3,792,308 A 2/1974 Ota
3,870,517 A 3/1975 Ota et al.
3,892,568 A 7/1975 Ota
3,972,040 A 7/1976 Hilsum et al.
4,041,481 A 8/1977 Sato
4,088,395 A 5/1978 Gigila
4,418,346 A 11/1983 Batchelder
4,430,648 A 2/1984 Togashi et al.
4,450,440 A 5/1984 White
4,741,604 A 5/1988 Kornfeld
4,746,917 A 5/1988 Di Santo et al.
4,833,464 A 5/1989 Di Santo et al.
4,947,157 A 8/1990 Di Santo et al.
4,947,159 A 8/1990 Di Santo et al.
5,066,946 A 11/1991 Disanto et al.
5,223,115 A 6/1993 DiSanto et al.
5,245,328 A 9/1993 Garrett
5,247,290 A 9/1993 Di Santo et al.
5,254,981 A 10/1993 Disanto et al.
5,266,937 A 11/1993 DiSanto et al.
5,293,528 A 3/1994 DiSanto et al.
5,302,235 A 4/1994 DiSanto et al.
5,412,398 A 5/1995 DiSanto et al.
5,467,107 A 11/1995 DiSanto et al.
5,467,217 A 11/1995 Check, III et al.
5,499,038 A 3/1996 DiSanto et al.
5,654,732 A 8/1997 Katakura
5,684,501 A 11/1997 Knapp et al.
5,689,282 A 11/1997 Wolfs et al.
5,717,515 A 2/1998 Sheridon
5,739,801 A 4/1998 Sheridon
5,745,094 A 4/1998 Gordon, II et al.
5,760,761 A 6/1998 Sheridon
5,777,782 A 7/1998 Sheridon
5,805,149 A 9/1998 Yuki et al.
5,808,783 A 9/1998 Crowley
5,866,284 A 2/1999 Vincent
5,872,552 A 2/1999 Gordon, II et al.
5,892,504 A 4/1999 Knapp
5,896,117 A 4/1999 Moon
5,930,026 A 7/1999 Jacobson et al.
5,933,203 A 8/1999 Wu et al.
5,961,804 A 10/1999 Jacobson et al.
5,963,456 A 10/1999 Klein et al.
5,978,052 A 11/1999 Ilcisin et al.
6,002,384 A 12/1999 Tamai et al.
6,017,584 A 1/2000 Albert et al.
6,034,807 A 3/2000 Little et al.
6,054,071 A 4/2000 Mikkelsen, Jr.
6,055,091 A 4/2000 Sheridon et al.
6,055,180 A 4/2000 Gudesen et al.
6,057,814 A 5/2000 Kalt
6,064,410 A 5/2000 Wen et al.
6,067,185 A 5/2000 Albert et al.
6,081,285 A 6/2000 Wen et al.
6,097,531 A 8/2000 Sheridon
6,118,426 A 9/2000 Albert et al.
6,120,588 A 9/2000 Jacobson
6,120,839 A 9/2000 Comiskey et al.
6,124,851 A 9/2000 Jacobson
6,128,124 A 10/2000 Silverman
6,130,773 A 10/2000 Jacobson et al.
6,130,774 A 10/2000 Albert et al.
6,137,467 A 10/2000 Sheridon et al.
6,144,361 A 11/2000 Gordon, II et al.
6,147,791 A 11/2000 Sheridon
6,154,190 A 11/2000 Yang et al.
6,172,798 B1 1/2001 Albert et al.
6,177,921 B1 1/2001 Comiskey et al.
6,184,856 B1 2/2001 Gordon, II et al.
6,211,998 B1 4/2001 Sheridon
6,225,971 B1 5/2001 Gordon, II et al.
6,232,950 B1 5/2001 Albert et al.
6,236,385 B1 5/2001 Nomura et al.
6,239,896 B1 5/2001 Ikeda
6,241,921 B1 6/2001 Jacobson et al.
6,249,271 B1 6/2001 Albert et al.
6,252,564 B1 6/2001 Albert et al.
6,262,706 B1 7/2001 Albert et al.
6,262,833 B1 7/2001 Loxley et al.
6,271,823 B1 8/2001 Gordon, II et al.
6,300,932 B1 10/2001 Albert
6,301,038 B1 10/2001 Fitzmaurice et al.
6,312,304 B1 11/2001 Duthaler et al.
6,312,971 B1 11/2001 Amundson et al.
6,320,565 B1 11/2001 Albu et al.
6,323,989 B1 11/2001 Jacobson et al.
6,327,072 B1 12/2001 Comiskey et al.
6,330,054 B1 12/2001 Ikami
6,348,908 B1 2/2002 Richley et al.
6,359,605 B1 3/2002 Knapp et al.
6,373,461 B1 4/2002 Hasegawa et al.
6,376,828 B1 4/2002 Comiskey
6,377,387 B1 4/2002 Duthaler et al.
6,392,678 B2 5/2002 Nakamura et al.
6,392,785 B1 5/2002 Albert et al.
6,392,786 B1 5/2002 Albert
6,407,763 B1 6/2002 Yamaguchi et al.
6,413,790 B1 7/2002 Duthaler et al.
6,421,033 B1 7/2002 Williams et al.
6,422,687 B1 7/2002 Jacobson
6,445,374 B2 9/2002 Albert et al.
6,445,489 B1 9/2002 Jacobson et al.
6,459,418 B1 10/2002 Comiskey et al.
6,462,837 B1 10/2002 Tone
6,473,072 B1 10/2002 Comiskey et al.
6,480,182 B2 11/2002 Turner et al.
6,498,114 B1 12/2002 Amundson et al.
6,504,524 B1 1/2003 Gates et al.
6,506,438 B2 1/2003 Duthaler et al.
6,512,354 B2 1/2003 Jacobson et al.
6,515,649 B1 2/2003 Albert et al.
6,518,949 B2 2/2003 Drzaic
6,521,489 B2 2/2003 Duthaler et al.
6,531,997 B1 3/2003 Gates et al.
6,535,197 B1 3/2003 Comiskey et al.
6,538,801 B2 3/2003 Jacobson et al.
6,545,291 B1 4/2003 Amundson et al.

(56) References Cited

U.S. PATENT DOCUMENTS 6,580,545 B2 6/2003 Morrison et al.
6,639,578 B1 10/2003 Comiskey et al.
6,650,462 B2 11/2003 Katase
6,652,075 B2 11/2003 Jacobson
6,657,612 B2 12/2003 Machida et al.
6,657,772 B2 12/2003 Loxley
6,664,944 B1 12/2003 Albert et al.
D485,294 S 1/2004 Albert
6,672,921 B1 1/2004 Liang et al.
6,680,725 B1 1/2004 Jacobson
6,683,333 B2 1/2004 Kazlas et al.
6,693,620 B1 2/2004 Herb et al.
6,704,133 B2 3/2004 Gates et al.
6,710,540 B1 3/2004 Albert et al.
6,721,083 B2 4/2004 Jacobson et al.
6,724,519 B1 4/2004 Comiskey et al.
6,727,881 B1 4/2004 Albert et al.
6,738,050 B2 5/2004 Comiskey et al.
6,750,473 B2 6/2004 Amundson et al.
6,753,844 B2 6/2004 Machida et al.
6,753,999 B2 6/2004 Zehner et al.
6,762,744 B2 7/2004 Katase
6,788,449 B2 9/2004 Liang et al.
6,816,147 B2 11/2004 Albert
6,819,471 B2 11/2004 Amundson et al.
6,822,782 B2 11/2004 Honeyman et al.
6,825,068 B2 11/2004 Denis et al.
6,825,829 B1 11/2004 Albert et al.
6,825,970 B2 11/2004 Goenaga et al.
6,831,769 B2 12/2004 Holman et al.
6,839,158 B2 1/2005 Albert et al.
6,842,167 B2 1/2005 Albert et al.
6,842,279 B2 1/2005 Amundson
6,842,657 B1 1/2005 Drzaic et al.
6,864,866 B2 3/2005 Aoki
6,864,875 B2 3/2005 Drzaic et al.
6,865,010 B2 3/2005 Duthaler et al.
6,866,760 B2 3/2005 Paolini Jr. et al.
6,870,657 B1 3/2005 Fitzmaurice et al.
6,870,661 B2 3/2005 Pullen et al.
6,900,851 B2 5/2005 Morrison et al.
6,922,276 B2 7/2005 Zhang et al.
6,950,220 B2 9/2005 Abramson et al.
6,956,557 B2 10/2005 Machida et al.
6,958,848 B2 10/2005 Cao et al.
6,967,640 B2 11/2005 Albert et al.
6,980,196 B1 12/2005 Turner et al.
6,982,178 B2 1/2006 LeCain et al.
6,987,603 B2 1/2006 Paolini, Jr. et al.
6,995,550 B2 2/2006 Jacobson et al.
7,002,728 B2 2/2006 Pullen et al.
7,012,600 B2 3/2006 Zehner et al.
7,012,735 B2 3/2006 Honeyman et al.
7,023,420 B2 4/2006 Comiskey et al.
7,030,412 B1 4/2006 Drzaic et al.
7,030,854 B2 4/2006 Baucom et al.
7,034,783 B2 4/2006 Gates et al.
7,038,648 B2 5/2006 Yamakawa
7,038,655 B2 5/2006 Herb et al.
7,071,913 B2 7/2006 Albert et al.
7,075,502 B1 7/2006 Drzaic et al.
7,081,720 B2 7/2006 Burau et al.
7,110,163 B2 9/2006 Webber et al.
7,116,318 B2 10/2006 Amundson et al.
7,116,466 B2 10/2006 Whitesides et al.
7,119,772 B2 10/2006 Amundson et al.
7,126,743 B2 10/2006 Johnson et al.
7,170,670 B2 1/2007 Webber
7,176,880 B2 2/2007 Amundson et al.
7,190,008 B2 3/2007 Amundson et al.
7,193,625 B2 3/2007 Danner et al.
7,202,847 B2 4/2007 Gates
7,202,991 B2 4/2007 Zhang et al.
7,223,672 B2 5/2007 Kazlas et al.
7,230,604 B2 6/2007 Machida et al.
7,230,750 B2 6/2007 Whitesides et al.
7,236,147 B2 6/2007 Morita et al.
7,236,291 B2 6/2007 Kaga et al.
7,256,766 B2 8/2007 Albert et al.
7,259,744 B2 8/2007 Arango et al.
7,280,094 B2 10/2007 Albert
7,304,787 B2 12/2007 Whitesides et al.
7,312,784 B2 12/2007 Baucom et al.
7,312,794 B2 12/2007 Zehner et al.
7,312,916 B2 12/2007 Pullen et al.
7,321,459 B2 1/2008 Masuda et al.
7,327,511 B2 2/2008 Whitesides et al.
7,339,715 B2 3/2008 Webber et al.
7,365,394 B2 4/2008 Denis et al.
7,365,733 B2 4/2008 Duthaler et al.
7,369,299 B2 5/2008 Sakurai et al.
7,388,572 B2 6/2008 Duthaler et al.
7,411,719 B2 8/2008 Paolini, Jr. et al.
7,420,549 B2 9/2008 Jacobson et al.
7,453,445 B2 11/2008 Amundson
7,492,339 B2 2/2009 Amundson
7,525,719 B2 4/2009 Yakushiji et al.
7,528,822 B2 5/2009 Amundson et al.
7,535,624 B2 5/2009 Amundson et al.
7,545,358 B2 6/2009 Gates et al.
7,561,324 B2 7/2009 Duthaler et al.
7,583,251 B2 9/2009 Arango et al.
7,602,374 B2 10/2009 Zehner et al.
7,605,799 B2 10/2009 Amundson et al.
7,612,760 B2 11/2009 Kawai
7,667,684 B2 2/2010 Jacobson et al.
7,679,814 B2 3/2010 Paolini, Jr. et al.
7,688,297 B2 3/2010 Zehner et al.
7,728,811 B2 6/2010 Albert et al.
7,729,039 B2 6/2010 LeCain et al.
7,733,311 B2 6/2010 Amundson et al.
7,733,335 B2 6/2010 Zehner et al.
7,773,069 B2 8/2010 Miyasaka et al.
7,787,169 B2 8/2010 Abramson et al.
7,804,483 B2 9/2010 Zhou et al.
7,839,564 B2 11/2010 Whitesides et al.
7,893,435 B2 2/2011 Kazlas et al.
7,952,557 B2 5/2011 Amundson et al.
7,956,841 B2 6/2011 Albert et al.
7,999,787 B2 8/2011 Amundson et al.
8,009,348 B2 8/2011 Zehner et al.
8,077,141 B2 12/2011 Duthaler et al.
8,106,856 B2 1/2012 Matas et al.
8,125,501 B2 2/2012 Amundson et al.
8,129,655 B2 3/2012 Jacobson et al.
8,139,050 B2 3/2012 Jacobson et al.
8,174,490 B2 5/2012 Whitesides et al.
8,289,250 B2 10/2012 Zehner et al.
8,293,824 B2 10/2012 Negishi et al.
8,300,006 B2 10/2012 Zhou et al.
8,314,784 B2 11/2012 Ohkami et al.
8,319,759 B2 11/2012 Jacobson et al.
8,319,766 B2 11/2012 Gormish
8,384,658 B2 2/2013 Albert et al.
8,466,852 B2 6/2013 Drzaic et al.
8,558,783 B2 10/2013 Wilcox et al.
8,928,562 B2 1/2015 Gates et al.
8,988,328 B2 3/2015 Kishi
2001/0026260 A1 10/2001 Yoneda et al.
2002/0060321 A1 5/2002 Kazlas et al.
2002/0090980 A1 7/2002 Wilcox et al.
2002/0113770 A1 8/2002 Jacobson et al.
2002/0196219 A1 12/2002 Matsunaga et al.
2003/0058223 A1 3/2003 Tracy et al.
2003/0102858 A1 6/2003 Jacobson et al.
2004/0051934 A1 3/2004 Machida et al.
2004/0105036 A1 6/2004 Danner et al.
2004/0119681 A1 6/2004 Albert et al.
2004/0120024 A1 6/2004 Chen et al.
2004/0190115 A1 9/2004 Liang et al.
2004/0239593 A1 12/2004 Yamada
2004/0246562 A1 12/2004 Chung et al.
2005/0012980 A1 1/2005 Wilcox et al.
2005/0018273 A1 1/2005 Honeyman et al.

(56) References Cited

U.S. PATENT DOCUMENTS

| | | | | |
|---|---|---|---|---|
| 2005/0253777 | A1 | 11/2005 | Zehner et al. | |
| 2005/0259068 | A1 | 11/2005 | Nihei et al. | |
| 2005/0285500 | A1 | 12/2005 | Hattori et al. | |
| 2006/0087479 | A1 | 4/2006 | Sakurai et al. | |
| 2006/0087489 | A1 | 4/2006 | Sakurai et al. | |
| 2006/0087718 | A1 | 4/2006 | Takagi et al. | |
| 2006/0209008 | A1 | 9/2006 | Nihei et al. | |
| 2006/0214906 | A1 | 9/2006 | Kobayashi et al. | |
| 2006/0231401 | A1 | 10/2006 | Sakurai et al. | |
| 2007/0091418 | A1 | 4/2007 | Danner et al. | |
| 2007/0103427 | A1 | 5/2007 | Zhou et al. | |
| 2007/0146306 | A1* | 6/2007 | Johnson | G09G 3/344 345/107 |
| 2008/0024429 | A1 | 1/2008 | Zehner | |
| 2008/0024482 | A1 | 1/2008 | Gates et al. | |
| 2008/0062159 | A1 | 3/2008 | Roh et al. | |
| 2008/0129667 | A1* | 6/2008 | Zehner | G09G 3/2011 345/87 |
| 2008/0136774 | A1 | 6/2008 | Harris et al. | |
| 2008/0291129 | A1 | 11/2008 | Harris et al. | |
| 2008/0291184 | A1 | 11/2008 | Zhou et al. | |
| 2009/0174651 | A1 | 7/2009 | Jacobson et al. | |
| 2009/0179923 | A1 | 7/2009 | Amundson et al. | |
| 2009/0195568 | A1 | 8/2009 | Sjodin | |
| 2009/0322721 | A1 | 12/2009 | Zehner et al. | |

FOREIGN PATENT DOCUMENTS

| | | | |
|---|---|---|---|
| EP | 1145072 | | 10/2001 |
| EP | 1462847 | | 9/2004 |
| EP | 1500971 | A1 | 1/2005 |
| EP | 1536271 | | 6/2005 |
| JP | 03091722 | | 4/1991 |
| JP | 03096925 | A | 4/1991 |
| JP | 05173194 | A | 7/1993 |
| JP | 06233131 | A | 8/1994 |
| JP | 09-015559 | | 1/1997 |
| JP | 09016116 | A | 1/1997 |
| JP | 09185087 | A | 7/1997 |
| JP | 09230391 | A | 9/1997 |
| JP | 11-075144 | | 3/1999 |
| JP | 11113019 | A | 4/1999 |
| JP | 2000221546 | | 8/2000 |
| JP | 2003122312 | | 4/2003 |
| JP | 2006064910 | | 3/2006 |
| JP | 2006209177 | | 8/2006 |
| WO | WO9910870 | | 3/1999 |
| WO | WO0005704 | | 2/2000 |
| WO | WO0036560 | | 6/2000 |
| WO | WO0038000 | | 6/2000 |
| WO | WO0067110 | | 11/2000 |
| WO | WO0107961 | A1 | 2/2001 |
| WO | WO0127690 | | 4/2001 |
| WO | WO2004079442 | | 9/2004 |
| WO | WO2005093705 | | 10/2005 |

OTHER PUBLICATIONS

O'Regan, B. et al., "A Low Cost, High-efficiency Solar Cell Based on Dye-sensitized colloidal TiO2 Films", Nature, vol. 353, Oct. 24, 1991, 773-740 Oct. 24, 1991.

Bach, U., et al., "Nanomaterials-Based Electrochromics for Paper-Quality Displays", Adv. Mater, 14(11), 845 (2002) Jun. 5, 2002.

Hayes, R.A., et al., "Video-Speed Electronic Paper Based on Electrowetting", Nature, vol. 425, Sep. 25, pp. 383-385 (2003) Sep. 25, 2003.

Kitamura, T., et al., "Electrical toner movement for electronic paper-like display", Asia Display/IDW '01, p. 1517, Paper HCS1-1 (2001) Dec. 31, 2001.

Yamaguchi, Y., et al., "Toner display using insulative particles charged triboelectrically", Asia Display/IDW '01, p. 1729, Paper AMD4-4 (2001) Dec. 31, 2001.

International Search Report and Written Opinion for PCT/US2011/031883 Oct. 25, 2011.

Antia, M., "Switchable Reflections Make Electronic Ink", Science, 285, 658 (1999) Dec. 31, 1999.

Chen, Y., et al., "A Conformable Electronic Ink Display using a Foil-Based a-Si TFT Array", SID 01 Digest, 157 (Jun. 2001) Jun. 30, 2001.

Comiskey, B., et al., "An electrophoretic ink for all-printed reflective electronic displays", Nature, 394, 253 (1998) Dec. 31, 1998.

Comiskey, B., et al., "Electrophoretic Ink: A Printable Display Material", SID 97 Digest (1997), p. 75 Dec. 31, 1997.

Drzaic, P., et al., "A Printed and Rollable Bistable Electronic Display", SID 98 Digest (1998), p. 1131 Dec. 31, 1998.

Duthaler, G., et al., "Active-Matrix Color Displays Using Electrophoretic Ink and Color Filters", SID 02 Digest, 1374 (2002) Dec. 31, 2002.

Hunt, R.W.G., "Measuring Color", 3d. Edn, Fountain Press (ISBN 0 86343 387 1), p. 63 (1998) Dec. 31, 1998.

Jacobson, J., et al., "The last book", IBM Systems J., 36, 457 (1997) Dec. 31, 1997.

Jo, G-R, et al., "Toner Display Based on Particle Movements", Chem. Mater, 14, 664 (2002) Dec. 31, 2002.

Kazlas, P., et al., "12.1 SVGA Microencapsulated Electrophoretic Active Matrix Display for Information Applicances", SID 01 Digest, 152 (Jun. 2001) Jun. 30, 2001.

Mossman, M.A., et al., "A New Reflective Color Display Technique Based on Total Internal Reflection and Substractive Color Filtering", SID 01 Digest, 1054 (2001) Dec. 31, 2001.

Pitt, M.G., et al., "Power Consumption of Microencapsulated Electrophoretic Displays for Smart Handheld Applications", SID 02 Digest, 1378 (2002) Dec. 31, 2002.

Poor, A., "Feed forward makes LCDs Faster", available at "http://www.extremetech.com/article2/0,3973,10085,00.asp" Sep. 24, 2001.

Shiffman, R.R., et al., "An Electrophoretic Image Display with Internal NMOS Address Logic and Display Drivers," Proceedings of the SID, 1984, vol. 25, 105 (1984) Dec. 31, 1984.

Singer, B., et al., "An X-Y Addressable Electrophoretic Display," Proceedings of the SID, 18, 255 (1977) Dec. 31, 1977.

Webber, R., "Image Stability in Active-Matrix Microencapsulated Electrophoretic Displays", SID 02 Digest, 126 (2002) Dec. 31, 2002.

Zehner, R. et al., "Drive Waveforms for Active Matrix Electrophoretic Displays", SID 03 Digest, 842 (2003) Dec. 31, 2003.

LG. Philips, Product Specification for Liquid Crystal Display LB121S1-A2 (ESPACENET Archive No. XP002443278) Dec. 6, 1999.

Amundson, K, et al., "12.3: Flexible, Active-Matrix Display Constructed Using a Microencapsulated Electrophoretic Material and an Organic-Semiconductor-Based Backplane", SID 01 Digest, 160 (Jun. 2001) Jun. 30, 2001.

Korean Intellectual Property Office; PCT/US2016/060427; International Search Report and Written Opinion; Feb. 8, 2017. Feb. 8, 2017.

* cited by examiner

METHODS FOR DRIVING ELECTRO-OPTIC DISPLAYS

REFERENCE TO RELATED APPLICATIONS

This application is a divisional of application Ser. No. 13/083,637, filed Apr. 11, 2011 (Publication No. 2011/0285754), which claims the benefit of Application Ser. No. 61/322,355, filed Apr. 9, 2010. This application is also a continuation-in-part of copending application Ser. No. 12/411,643, filed Mar. 26, 2009 (Publication No. 2009/0179923), which is itself a division of application Ser. No. 10/879,335, filed Jun. 29, 2004 (now U.S. Pat. No. 7,528,822, issued May 5, 2009), which is itself a continuation-in-part of application Ser. No. 10/814,205, filed Mar. 31, 2004 (now U.S. Pat. No. 7,119,772 issued Oct. 10, 2006). The aforementioned application Ser. Nos. 12/411,643 and 10/879,335 claim benefit of Application Ser. No. 60/481,040, filed Jun. 30, 2003; of Application Ser. No. 60/481,053, filed Jul. 2, 2003; and of Application Ser. No. 60/481,405, filed Sep. 22, 2003. The aforementioned application Ser. No. 10/814,205 claims benefit of Application Ser. No. 60/320,070, filed Mar. 31, 2003; of Application Ser. No. 60/320,207, filed May 5, 2003; of Application Ser. No. 60/481,669, filed Nov. 19, 2003; of Application Ser. No. 60/481,675, filed Nov. 20, 2003; and of Application Ser. No. 60/557,094, filed Mar. 26, 2004. All of the above-listed applications are incorporated by reference herein.

This application is related to U.S. Pat. Nos. 5,930,026; 6,445,489; 6,504,524; 6,512,354; 6,531,997; 6,753,999; 6,825,970; 6,900,851; 6,995,550; 7,012,600; 7,023,420; 7,034,783; 7,116,466; 7,119,772; 7,193,625; 7,202,847; 7,259,744; 7,304,787; 7,312,794; 7,327,511; 7,453,445; 7,492,339; 7,528,822; 7,545,358; 7,583,251; 7,602,374; 7,612,760; 7,679,599; 7,688,297; 7,729,039; 7,733,311; 7,733,335; and 7,787,169; and U.S. Patent Applications Publication Nos. 2003/0102858; 2005/0122284; 2005/0179642; 2005/0253777; 2005/0280626; 2006/0038772; 2006/0139308; 2007/0013683; 2007/0091418; 2007/0103427; 2007/0200874; 2008/0024429; 2008/0024482; 2008/0048969; 2008/0129667; 2008/0136774; 2008/0150888; 2008/0165122; 2008/0211764; 2008/0291129; 2009/0174651; 2009/0179923; 2009/0195568; 2009/0256799; and 2009/0322721.

The aforementioned patents and applications may hereinafter for convenience collectively be referred to as the "MEDEOD" (MEthods for Driving Electro-Optic Displays) applications. The entire contents of these patents and copending applications, and of all other U.S. patents and published and copending applications mentioned below, are herein incorporated by reference.

BACKGROUND OF INVENTION

The present invention relates to methods for driving electro-optic displays, especially bistable electro-optic displays, and to apparatus for use in such methods. More specifically, this invention relates to driving methods which may allow for rapid response of the display to user input. This invention also relates to methods which may allow reduced "ghosting" in such displays. This invention is especially, but not exclusively, intended for use with particle-based electrophoretic displays in which one or more types of electrically charged particles are present in a fluid and are moved through the fluid under the influence of an electric field to change the appearance of the display.

The term "electro-optic", as applied to a material or a display, is used herein in its conventional meaning in the imaging art to refer to a material having first and second display states differing in at least one optical property, the material being changed from its first to its second display state by application of an electric field to the material. Although the optical property is typically color perceptible to the human eye, it may be another optical property, such as optical transmission, reflectance, luminescence or, in the case of displays intended for machine reading, pseudo-color in the sense of a change in reflectance of electromagnetic wavelengths outside the visible range.

The term "gray state" is used herein in its conventional meaning in the imaging art to refer to a state intermediate two extreme optical states of a pixel, and does not necessarily imply a black-white transition between these two extreme states. For example, several of the E Ink patents and published applications referred to below describe electrophoretic displays in which the extreme states are white and deep blue, so that an intermediate "gray state" would actually be pale blue. Indeed, as already mentioned, the change in optical state may not be a color change at all. The terms "black" and "white" may be used hereinafter to refer to the two extreme optical states of a display, and should be understood as normally including extreme optical states which are not strictly black and white, for example the aforementioned white and dark blue states. The term "monochrome" may be used hereinafter to denote a drive scheme which only drives pixels to their two extreme optical states with no intervening gray states.

The terms "bistable" and "bistability" are used herein in their conventional meaning in the art to refer to displays comprising display elements having first and second display states differing in at least one optical property, and such that after any given element has been driven, by means of an addressing pulse of finite duration, to assume either its first or second display state, after the addressing pulse has terminated, that state will persist for at least several times, for example at least four times, the minimum duration of the addressing pulse required to change the state of the display element. It is shown in U.S. Pat. No. 7,170,670 that some particle-based electrophoretic displays capable of gray scale are stable not only in their extreme black and white states but also in their intermediate gray states, and the same is true of some other types of electro-optic displays. This type of display is properly called "multi-stable" rather than bistable, although for convenience the term "bistable" may be used herein to cover both bistable and multi-stable displays.

The term "impulse" is used herein in its conventional meaning of the integral of voltage with respect to time. However, some bistable electro-optic media act as charge transducers, and with such media an alternative definition of impulse, namely the integral of current over time (which is equal to the total charge applied) may be used. The appropriate definition of impulse should be used, depending on whether the medium acts as a voltage-time impulse transducer or a charge impulse transducer.

Much of the discussion below will focus on methods for driving one or more pixels of an electro-optic display through a transition from an initial gray level to a final gray level (which may or may not be different from the initial gray level). The term "waveform" will be used to denote the entire voltage against time curve used to effect the transition from one specific initial gray level to a specific final gray level. Typically such a waveform will comprise a plurality of waveform elements; where these elements are essentially rectangular (i.e., where a given element comprises application of a constant voltage for a period of time); the elements may be called "pulses" or "drive pulses". The term "drive scheme" denotes a set of waveforms sufficient to effect all possible transitions between gray levels for a specific display. A display may make use of more than one drive scheme; for example, the aforementioned U.S. Pat. No. 7,012,600 teaches that a drive scheme may need to be modified depending upon parameters such as the temperature of the display or the time for which it has been in operation during its lifetime, and thus a display may be provided with a plurality of different drive schemes to be used at differing temperature etc. A set of drive schemes used in this manner may be referred to as "a set of related drive schemes." It is also possible, as described in several of the aforementioned MEDEOD applications, to use more than one drive scheme simultaneously in different areas of the same display, and a set of drive schemes used in this manner may be referred to as "a set of simultaneous drive schemes."

Several types of electro-optic displays are known. One type of electro-optic display is a rotating bichromal member type as described, for example, in U.S. Pat. Nos. 5,808,783; 5,777,782; 5,760,761; 6,054,071 6,055,091; 6,097,531; 6,128,124; 6,137,467; and 6,147,791 (although this type of display is often referred to as a "rotating bichromal ball" display, the term "rotating bichromal member" is preferred as more accurate since in some of the patents mentioned above the rotating members are not spherical). Such a display uses a large number of small bodies (typically spherical or cylindrical) which have two or more sections with differing optical characteristics, and an internal dipole. These bodies are suspended within liquid-filled vacuoles within a matrix, the vacuoles being filled with liquid so that the bodies are free to rotate. The appearance of the display is changed by applying an electric field thereto, thus rotating the bodies to various positions and varying which of the sections of the bodies is seen through a viewing surface. This type of electro-optic medium is typically bistable.

Another type of electro-optic display uses an electrochromic medium, for example an electrochromic medium in the form of a nanochromic film comprising an electrode formed at least in part from a semi-conducting metal oxide and a plurality of dye molecules capable of reversible color change attached to the electrode; see, for example O'Regan, B., et al., Nature 1991, 353, 737; and Wood, D., Information Display, 18(3), 24 (March 2002). See also Bach, U., et al., Adv. Mater., 2002, 14(11), 845. Nanochromic films of this type are also described, for example, in U.S. Pat. Nos. 6,301,038; 6,870,657; and 6,950,220. This type of medium is also typically bistable.

Another type of electro-optic display is an electro-wetting display developed by Philips and described in Hayes, R. A., et al., "Video-Speed Electronic Paper Based on Electrowetting", Nature, 425, 383-385 (2003). It is shown in U.S. Pat. No. 7,420,549 that such electro-wetting displays can be made bistable.

One type of electro-optic display, which has been the subject of intense research and development for a number of years, is the particle-based electrophoretic display, in which a plurality of charged particles move through a fluid under the influence of an electric field. Electrophoretic displays can have attributes of good brightness and contrast, wide viewing angles, state bistability, and low power consumption when compared with liquid crystal displays. Nevertheless, problems with the long-term image quality of these displays have prevented their widespread usage. For example, particles that make up electrophoretic displays tend to settle, resulting in inadequate service-life for these displays.

As noted above, electrophoretic media require the presence of a fluid. In most prior art electrophoretic media, this fluid is a liquid, but electrophoretic media can be produced using gaseous fluids; see, for example, Kitamura, T., et al., "Electrical toner movement for electronic paper-like display", IDW Japan, 2001, Paper HCS1-1, and Yamaguchi, Y., et al., "Toner display using insulative particles charged triboelectrically", IDW Japan, 2001, Paper AMD4-4). See also U.S. Pat. Nos. 7,321,459 and 7,236,291. Such gas-based electrophoretic media appear to be susceptible to the same types of problems due to particle settling as liquid-based electrophoretic media, when the media are used in an orientation which permits such settling, for example in a sign where the medium is disposed in a vertical plane. Indeed, particle settling appears to be a more serious problem in gas-based electrophoretic media than in liquid-based ones, since the lower viscosity of gaseous suspending fluids as compared with liquid ones allows more rapid settling of the electrophoretic particles.

Numerous patents and applications assigned to or in the names of the Massachusetts Institute of Technology (MIT) and E Ink Corporation describe various technologies used in encapsulated electrophoretic and other electro-optic media. Such encapsulated media comprise numerous small capsules, each of which itself comprises an internal phase containing electrophoretically-mobile particles in a fluid medium, and a capsule wall surrounding the internal phase. Typically, the capsules are themselves held within a polymeric binder to form a coherent layer positioned between two electrodes. The technologies described in the these patents and applications include:

(a) Electrophoretic particles, fluids and fluid additives; see for example U.S. Pat. Nos. 7,002,728; and 7,679,814;
(b) Capsules, binders and encapsulation processes; see for example U.S. Pat. Nos. 6,922,276; and 7,411,719;
(c) Films and sub-assemblies containing electro-optic materials; see for example U.S. Pat. Nos. 6,982,178; and 7,839,564;
(d) Backplanes, adhesive layers and other auxiliary layers and methods used in displays; see for example U.S. Pat. Nos. 7,116,318; and 7,535,624;
(e) Color formation and color adjustment; see for example U.S. Pat. No. 7,075,502; and U.S. Patent Application Publication No. 2007/0109219;
(f) Methods for driving displays; see the aforementioned MEDEOD applications;
(g) Applications of displays; see for example U.S. Pat. No. 7,312,784; and U.S. Patent Application Publication No. 2006/0279527; and
(h) Non-electrophoretic displays, as described in U.S. Pat. Nos. 6,241,921; 6,950,220; and 7,420,549; and U.S. Patent Application Publication No. 2009/0046082.

Many of the aforementioned patents and applications recognize that the walls surrounding the discrete microcapsules in an encapsulated electrophoretic medium could be replaced by a continuous phase, thus producing a so-called polymer-dispersed electrophoretic display, in which the electrophoretic medium comprises a plurality of discrete droplets of an electrophoretic fluid and a continuous phase of a polymeric material, and that the discrete droplets of electrophoretic fluid within such a polymer-dispersed electrophoretic display may be regarded as capsules or microcapsules even though no discrete capsule membrane is associated with each individual droplet; see for example, the aforementioned U.S. Pat. No. 6,866,760. Accordingly, for purposes of the present application, such polymer-dispersed electrophoretic media are regarded as sub-species of encapsulated electrophoretic media.

A related type of electrophoretic display is a so-called "microcell electrophoretic display". In a microcell electrophoretic display, the charged particles and the fluid are not encapsulated within microcapsules but instead are retained within a plurality of cavities formed within a carrier medium, typically a polymeric film. See, for example, U.S. Pat. Nos. 6,672,921 and 6,788,449, both assigned to Sipix Imaging, Inc.

Although electrophoretic media are often opaque (since, for example, in many electrophoretic media, the particles substantially block transmission of visible light through the display) and operate in a reflective mode, many electrophoretic displays can be made to operate in a so-called "shutter mode" in which one display state is substantially opaque and one is light-transmissive. See, for example, U.S. Pat. Nos. 5,872,552; 6,130,774; 6,144,361; 6,172,798; 6,271,823; 6,225,971; and 6,184,856. Dielectrophoretic displays, which are similar to electrophoretic displays but rely upon variations in electric field strength, can operate in a similar mode; see U.S. Pat. No. 4,418,346. Other types of electro-optic displays may also be capable of operating in shutter mode. Electro-optic media operating in shutter mode may be useful in multi-layer structures for full color displays; in such structures, at least one layer adjacent the viewing surface of the display operates in shutter mode to expose or conceal a second layer more distant from the viewing surface.

An encapsulated electrophoretic display typically does not suffer from the clustering and settling failure mode of traditional electrophoretic devices and provides further advantages, such as the ability to print or coat the display on a wide variety of flexible and rigid substrates. (Use of the word "printing" is intended to include all forms of printing and coating, including, but without limitation: pre-metered coatings such as patch die coating, slot or extrusion coating, slide or cascade coating, curtain coating; roll coating such as knife over roll coating, forward and reverse roll coating; gravure coating; dip coating; spray coating; meniscus coating; spin coating; brush coating; air knife coating; silk screen printing processes; electrostatic printing processes; thermal printing processes; ink jet printing processes; electrophoretic deposition (See U.S. Pat. No. 7,339,715); and other similar techniques.) Thus, the resulting display can be flexible. Further, because the display medium can be printed (using a variety of methods), the display itself can be made inexpensively.

Other types of electro-optic media may also be used in the displays of the present invention.

The bistable or multi-stable behavior of particle-based electrophoretic displays, and other electro-optic displays displaying similar behavior (such displays may hereinafter for convenience be referred to as "impulse driven displays"), is in marked contrast to that of conventional liquid crystal ("LC") displays. Twisted nematic liquid crystals are not bi- or multi-stable but act as voltage transducers, so that applying a given electric field to a pixel of such a display produces a specific gray level at the pixel, regardless of the gray level previously present at the pixel. Furthermore, LC displays are only driven in one direction (from non-transmissive or "dark" to transmissive or "light"), the reverse transition from a lighter state to a darker one being effected by reducing or eliminating the electric field. Finally, the gray level of a pixel of an LC display is not sensitive to the polarity of the electric field, only to its magnitude, and indeed for technical reasons commercial LC displays usually reverse the polarity of the driving field at frequent intervals. In contrast, bistable electro-optic displays act, to a first approximation, as impulse transducers, so that the final state of a pixel depends not only upon the electric field applied and the time for which this field is applied, but also upon the state of the pixel prior to the application of the electric field.

Whether or not the electro-optic medium used is bistable, to obtain a high-resolution display, individual pixels of a display must be addressable without interference from adjacent pixels. One way to achieve this objective is to provide an array of non-linear elements, such as transistors or diodes, with at least one non-linear element associated with each pixel, to produce an "active matrix" display. An addressing or pixel electrode, which addresses one pixel, is connected to an appropriate voltage source through the associated non-linear element. Typically, when the non-linear element is a transistor, the pixel electrode is connected to the drain of the transistor, and this arrangement will be assumed in the following description, although it is essentially arbitrary and the pixel electrode could be connected to the source of the transistor. Conventionally, in high resolution arrays, the pixels are arranged in a two-dimensional array of rows and columns, such that any specific pixel is uniquely defined by the intersection of one specified row and one specified column. The sources of all the transistors in each column are connected to a single column electrode, while the gates of all the transistors in each row are connected to a single row electrode; again the assignment of sources to rows and gates to columns is conventional but essentially arbitrary, and could be reversed if desired. The row electrodes are connected to a row driver, which essentially ensures that at any given moment only one row is selected, i.e., that there is applied to the selected row electrode a voltage such as to ensure that all the transistors in the selected row are conductive, while there is applied to all other rows a voltage such as to ensure that all the transistors in these non-selected rows remain non-conductive. The column electrodes are connected to column drivers, which place upon the various column electrodes voltages selected to drive the pixels in the selected row to their desired optical states. (The aforementioned voltages are relative to a common front electrode which is conventionally provided on the opposed side of the electro-optic medium from the non-linear array and extends across the whole display.) After a pre-selected interval known as the "line address time" the selected row is deselected, the next row is selected, and the voltages on the column drivers are changed so that the next line of the display is written. This process is repeated so that the entire display is written in a row-by-row manner.

It might at first appear that the ideal method for addressing such an impulse-driven electro-optic display would be so-called "general grayscale image flow" in which a controller arranges each writing of an image so that each pixel transitions directly from its initial gray level to its final gray level. However, inevitably there is some error in writing images on an impulse-driven display. Some such errors encountered in practice include:

(a) Prior State Dependence; With at least some electro-optic media, the impulse required to switch a pixel to a new optical state depends not only on the current and desired optical state, but also on the previous optical states of the pixel.

(b) Dwell Time Dependence; With at least some electro-optic media, the impulse required to switch a pixel to a new optical state depends on the time that the pixel has spent in its various optical states. The precise nature of this dependence is not well understood, but in general, more impulse is required the longer the pixel has been in its current optical state.

(c) Temperature Dependence; The impulse required to switch a pixel to a new optical state depends heavily on temperature.

(d) Humidity Dependence; The impulse required to switch a pixel to a new optical state depends, with at least some types of electro-optic media, on the ambient humidity.

(e) Mechanical Uniformity; The impulse required to switch a pixel to a new optical state may be affected by mechanical variations in the display, for example variations in the thickness of an electro-optic medium or an associated lamination adhesive. Other types of mechanical non-uniformity may arise from inevitable variations between different manufacturing batches of medium, manufacturing tolerances and materials variations.

(f) Voltage Errors; The actual impulse applied to a pixel will inevitably differ slightly from that theoretically applied because of unavoidable slight errors in the voltages delivered by drivers.

General grayscale image flow suffers from an "accumulation of errors" phenomenon. For example, imagine that temperature dependence results in a 0.2 L* (where L* has the usual CIE definition:

$$L^*=116(R/R_0)^{1/3}-16,$$

where R is the reflectance and $R_0$ is a standard reflectance value) error in the positive direction on each transition. After fifty transitions, this error will accumulate to 10 L*. Perhaps more realistically, suppose that the average error on each transition, expressed in terms of the difference between the theoretical and the actual reflectance of the display is ±0.2 L*. After 100 successive transitions, the pixels will display an average deviation from their expected state of 2 L*; such deviations are apparent to the average observer on certain types of images.

This accumulation of errors phenomenon applies not only to errors due to temperature, but also to errors of all the types listed above. As described in the aforementioned U.S. Pat. No. 7,012,600, compensating for such errors is possible, but only to a limited degree of precision. For example, temperature errors can be compensated by using a temperature sensor and a lookup table, but the temperature sensor has a limited resolution and may read a temperature slightly different from that of the electro-optic medium. Similarly, prior state dependence can be compensated by storing the prior states and using a multi-dimensional transition matrix, but controller memory limits the number of states that can be recorded and the size of the transition matrix that can be stored, placing a limit on the precision of this type of compensation.

Thus, general grayscale image flow requires very precise control of applied impulse to give good results, and empirically it has been found that, in the present state of the technology of electro-optic displays, general grayscale image flow is infeasible in a commercial display.

Under some circumstances, it may be desirable for a single display to make use of multiple drive schemes. For example, a display capable of more than two gray levels may make use of a gray scale drive scheme ("GSDS") which can effect transitions between all possible gray levels, and a monochrome drive scheme ("MDS") which effects transitions only between two gray levels, the MDS providing quicker rewriting of the display that the GSDS. The MDS is used when all the pixels which are being changed during a rewriting of the display are effecting transitions only between the two gray levels used by the MDS. For example, the aforementioned U.S. Pat. No. 7,119,772 describes a display in the form of an electronic book or similar device capable of displaying gray scale images and also capable of displaying a monochrome dialogue box which permits a user to enter text relating to the displayed images. When the user is entering text, a rapid MDS is used for quick updating of the dialogue box, thus providing the user with rapid confirmation of the text being entered. On the other hand, when the entire gray scale image shown on the display is being changed, a slower GSDS is used.

Alternatively, a display may make use of a GSDS simultaneously with a "direct update" drive scheme ("DUDS"). The DUDS may have two or more than two gray levels, typically fewer than the GSDS, but the most important characteristic of a DUDS is that transitions are handled by a simple unidirectional drive from the initial gray level to the final gray level, as opposed to the "indirect" transitions often used in a GSDS, where in at least some transitions the pixel is driven from an initial gray level to one extreme optical state, then in the reverse direction to a final gray level; in some cases, the transition may be effected by driving from the initial gray level to one extreme optical state, thence to the opposed extreme optical state, and only then to the final extreme optical state—see, for example, the drive scheme illustrated in FIGS. 11A and 11B of the aforementioned U.S. Pat. No. 7,012,600. Thus, present electrophoretic displays have an update time in grayscale mode of about two to three times the length of a saturation pulse (where "the length of a saturation pulse" is defined as the time period, at a specific voltage, that suffices to drive a pixel of a display from one extreme optical state to the other), or approximately 700-900 milliseconds, whereas a DUDS has a maximum update time equal to the length of the saturation pulse, or about 200-300 milliseconds.

However, there are some circumstances in which it is desirable to provide an additional drive scheme (hereinafter for convenience referred to as an "application update drive scheme" or "AUDS") with a maximum update time even shorter than that of a DUDS, and thus less than the length of the saturation pulse, even if such rapid updates compromise the quality of the image produced. An AUDS may be desirable for interactive applications, such as drawing on the display using a stylus and a touch sensor, typing on a keyboard, menu selection, and scrolling of text or a cursor. One specific application where an AUDS may be useful is electronic book readers which simulate a physical book by showing images of pages being turned as the user pages through an electronic book, in some cases by gesturing on a touch screen. During such page turning, rapid motion through the relevant pages is of greater importance than the contrast ratio or quality of the images of the pages being turned; once the user has selected his desired page, the image of that page can be rewritten at higher quality using the GSDS drive scheme. Prior art electrophoretic displays are thus limited in interactive applications. However, since the maximum update time of the AUDS is less than the length of the saturation pulse, the extreme optical states obtainable by the AUDS will be different from those of a DUDS; in effect, the limited update time of the AUDS does not allow the pixel to be driven to the normal extreme optical states.

However, there is an additional complication to the use of an AUDS, namely the need for overall DC balance. As discussed in many of the aforementioned MEDEOD applications, the electro-optic properties and the working lifetime of displays may be adversely affected if the drive scheme(s) used are not substantially DC balanced (i.e., if the algebraic sum of the impulses applied to a pixel during any series of transitions beginning and ending at the same gray level is not close to zero). See especially the aforementioned U.S. Pat. No. 7,453,445, which discusses the problems of DC balancing in so-called "heterogeneous loops" involving transitions carried out using more than one drive scheme. In any display which uses a GSDS and an AUDS, it is unlikely that the two drive schemes will be overall DC balanced because of the need for high speed transitions in the AUDS. (In general, it is possible to use a GSDS and a DUDS simultaneously while still preserving overall DC balance.) Accordingly, it is desirable to provide some method of driving a display using both a GSDS and an AUDS which allows for overall DC balancing, and one aspect of the present invention relates to such a method.

A second aspect of the present invention relates to methods for reducing so-called "ghosting" in electro-optic displays. Certain drive schemes for such displays, especially drive schemes intended to reduce flashing of the display, leave "ghost images" (faint copies of previous images) on the display. Such ghost images are distracting to the user, and reduce the perceived quality of the image, especially after multiple updates. One situation where such ghost images are a problem is when an electronic book reader is used to scroll through an electronic book, as opposed to jumping between separate pages of the book.

SUMMARY OF INVENTION

Accordingly, in one aspect, this invention provides a first method of operating an electro-optic display using two different drive schemes. In this method, the display is driven to a pre-determined transition image using the first drive scheme. The display is then driven to a second image, different from the transition image, using the second drive scheme. The display is thereafter driven to the same transition image using the second drive scheme. Finally, the display is driven to a third image, different from both the transition and the second image, using the first drive scheme.

This method of the present invention may hereinafter be called the "transition image" or "TI" method of the invention. In this method, the first drive scheme is preferably a gray scale drive scheme capable of driving the display to at least four, and preferably at least eight, gray levels, and having a maximum update time greater than the length of the saturation pulse (as defined above). The second drive scheme is preferably an AUDS having fewer gray levels than the gray scale drive scheme and a maximum update time less than the length of the saturation pulse.

In another aspect, this invention provides a second method of operating an electro-optic display using first and second drive schemes differing from each other and at least one transition drive scheme different from both the first and second drive schemes, the method comprising, in this order: driving the display to a first image using the first drive scheme; driving the display to a second image, different from the transition image, using the transition drive scheme; driving the display to a third image, different from the second image using the second drive scheme; driving the display to a fourth image, different from the third image, using the transition drive scheme; and driving the display to a fifth image, different from both the fourth image, using the first drive scheme.

The second method of the present invention differs from the first in that no transition specific transition image is formed on the display. Instead, a special transition drive scheme, the characteristics of which are discussed below, is used to effect, the transition between the two main drive schemes. In some cases, separate transition drive schemes will be required for the transitions from the first to the second image and from the third to the fourth image; in other cases, a single transition drive scheme may suffice.

In another aspect, this invention provides a method of operating an electro-optic display in which an image is scrolled across the display, and in which a clearing bar is provided between two portions of the image being scrolled, the clearing bar scrolling across in display in synchronization with said two portions of the image, the writing of the clearing bar being effected such that every pixel over which the clearing bar passes is rewritten.

In another aspect, this invention provides a method of operating an electro-optic display in which a image is formed on the display, and in which a clearing bar is provided which travels across the image on the display, such that every pixel over which the clearing bar passes is rewritten.

In all the methods of the present invention, the display may make use of any of the type of electro-optic media discussed above. Thus, for example, the electro-optic display may comprise a rotating bichromal member or electrochromic material. Alternatively, the electro-optic display may comprise an electrophoretic material comprising a plurality of electrically charged particles disposed in a fluid and capable of moving through the fluid under the influence of an electric field. The electrically charged particles and the fluid may be confined within a plurality of capsules or microcells. Alternatively, the electrically charged particles and the fluid may be present as a plurality of discrete droplets surrounded by a continuous phase comprising a polymeric material. The fluid may be liquid or gaseous.

DETAILED DESCRIPTION

Figure 1:
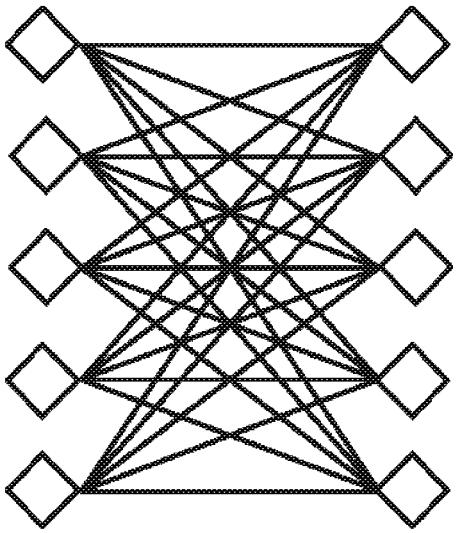
FIG. 1 of the accompanying drawings illustrates schematically a gray level drive scheme used to drive an electro-optic display.

As already mentioned in one aspect this invention provides two different but related methods of operating an electro-optic display using two different drive schemes. In the first of these two methods, the display is first driven to a pre-determined transition image using a first drive scheme, then rewritten to a second image using a second drive scheme. The display is thereafter returned to the same transition image using the second drive scheme, and finally driven to a third image using the first drive scheme. In this "transition image" ("TI") driving method, the transition image acts as a known changeover image between the first and second driving schemes. It will be appreciated that more than one image may be written on the display using the second drive scheme between the two occurrences of the transition image. Provided that the second drive scheme (which is typically and AUDS) is substantially DC balanced, there will be little or no DC imbalance caused by use of the second drive scheme between the two occurrences of the same transition image as the display transitions from the first to the second and back to the first drive scheme (which is typically a GSDS).

Since the same transition image is used for the first-second (GSDS-AUDS) transition and for the reverse (second-first) transition, the exact nature of the transition image does not affect the operation of the TI method of the invention, and the transition image can be chosen arbitrarily. Typically, the transition image will be chosen to minimize the visual effect of the transition. The transition image could, for example, be chosen as solid white or black, or a solid gray tone, or could be patterned in a manner having some advantageous quality. In other words, the transition image can be arbitrary but each pixel of this image must have a predetermined value. It will also be apparent that since both the first and the second drive schemes must effect a change from the transition image to a different image, the transition image must be one which can be handled by both the first and second drive schemes, i.e., the transition image must be limited to a number of gray levels equal to the lesser of the number of gray levels employed by the first and second drive schemes. The transition image can be interpreted differently by each drive scheme but it must be treated consistently by each drive scheme. Furthermore, provided that the same transition image is used for a particular first-second transition and for the reverse transition immediately following, it is not essential that the same transition image be used for every pair of transitions; a plurality of different transition images could be provided and the display controller arranged to choose a particular transition image depending upon, for example, the nature of the image already present on the display, in order to minimize flashing. The TI method of the present invention could also use multiple successive transition images to further improve image performance at the cost of slower transitions.

Since DC balancing of electro-optic displays needs to be achieved on a pixel-by-pixel basis (i.e., the drive scheme must ensure that each pixel is substantially DC balanced), the TI method of the present invention may be used where only part of a display is being switched to a second drive scheme, for example where it is desired to provide an on-screen text box to display text input from a keyboard, or to provide an on-screen keyboard in which individual keys flash to confirm input.

The TI method of the present invention is not confined to methods using only a GSDS in addition to the AUDS. Indeed, in one preferred embodiment of the TI method, the display is arranged to use a GSDS, a DUDS and an AUDS. In one preferred form of such a method, since the AUDS has an update time less than the saturation pulse, the white and black optical states achieved by the AUDS are reduced compared to those achieved by the DUDS and GSDS (i.e., the white and black optical states achieved by the AUDS are actually very light gray and very dark gray compared with the "true" black and white states achieved by the GSDS) and there is increased variability in the optical states achieved by the AUDS compared with those achieved by the GSDS and DUDS due to prior-state (history) and dwell time effects leading to undesirable reflectance errors and image artifacts. To reduce these errors it is proposed to use the following image sequence.

The GC waveform will transition from an n-bit image to an n-bit image.

The DU waveform will transition an n-bit (or less than n-bit) image to an m-bit image where m<=n.

The AU waveform will transition a p-bit image to a p-bit image; typically, n=4, m=1, and p=1, or n=4, m=2 or 1, p=2 or 1.

—GC->image n−1—GC or DU->transition image—AU->image n—AU->image n+1—AU-> . . . —AU->image n+m−1—AU->image n+m—AU->transition image—GC or DU->image n+m+1

From the foregoing, it will be seen that in the TI method of the present invention the AUDS may need little or no tuning and can be much faster that the other drive schemes (GSDS or DUDS) used. DC balance is maintained by the use of the transition image and the dynamic range of the slower drive schemes (GSDS and DUDS) is maintained. The image quality achieved can be better than not using intermediate updates. The image quality can be improved during the AUDS updating since the first AUDS update can be applied to a (transition) image having desirable attributes. For a solid image, the image quality can be improved by having the AUDS update applied to a uniform background. This reduces previous state ghosting. The image quality after the last intermediate update can also be improved by have the GSDS or DUDS update applied to a uniform background.

In the second method of the present invention (which may hereinafter be referred to as a "transition drive scheme" or "TDS" method), a transition image is not used, but instead a transition drive scheme is used; a single transition using the transition drive scheme replaces last transition using the first drive scheme (which generates the transition image) and the first transition using the second drive scheme (which transitions from the transition image to the second image). In some cases, two different transition drive schemes may be required depending upon the direction of the transition; in others, a single transition drive scheme will suffice for transitions in either direction. Note that a transition drive scheme is only applied once to each pixel, and is not repeatedly applied to the same pixel, as are the main (first and second) drive schemes.

The TI and TDS methods of the present invention will not be explained in more detail with reference to the accompanying drawings which illustrate, in a highly schematic manner, transitions occurring in these two methods. In all the accompanying drawings, time increases from left to right, the squares or circles represent gray levels, and the lines connecting these squares or circles represent gray level transitions.

FIG. 1 illustrates schematically a standard gray scale waveform having N gray levels (illustrated as N=6, where the gray levels are indicated by squares) and N×N transitions illustrated by the lines linking the initial gray level of a transition (on the left hand side of FIG. 1) with the final gray level (on the right hand side). (Note that it is necessary to provide for zero transitions where the initial and final gray levels are the same; as explained in several of the MEDEOD applications mentioned above, typically zero transitions still involve application of periods of non-zero voltage to the relevant pixel). Each gray level has not only a specific gray level (reflectance) but, if as is desirable the overall drive scheme is DC balanced (i.e., the algebraic sum of the impulses applied to a pixel over any series of transitions beginning and ending at the same gray level is substantially zero), a specific DC offset. The DC offsets are not necessarily evenly space or even unique. So for a waveform with N gray levels, there will be a DC offset that corresponds to each of those gray levels.

When a set of drive schemes are DC balanced to each other, the path taken to get to a specific gray level may vary but the total DC offset for each gray level is the same. Thus, one can switch drive schemes within the set balanced to each other without worrying about incurring a growing DC imbalance, which can cause damage to certain types of display as discussed in the aforementioned MEDEOD applications.

The aforementioned DC offsets are measured relative to one another, i.e., the DC offset for one gray level is set arbitrarily to zero arbitrary and the DC offsets of the remaining gray levels are measured relative to this arbitrary zero.

Figure 2:
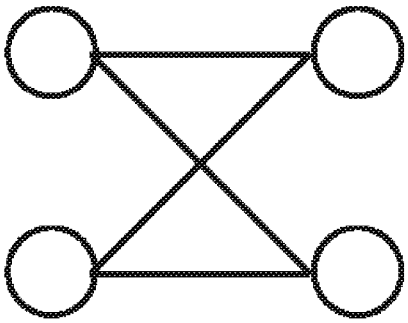
FIG. 2 illustrates schematically a gray level drive scheme used to drive an electro-optic display.

FIG. 2 is a diagram similar to FIG. 1 but illustrating a monochrome drive scheme (N=2).

If a display has two drive schemes which are not DC balanced to each other (i.e., their DC offsets between particular gray levels are different; this does not necessarily imply that the two drive schemes have differing numbers of gray levels), it is still possible to switch between the two drive schemes without incurring an increasingly large DC imbalance over time. However, particular care need be taken in switching between the drive schemes. The necessary transition can be accomplished using a transition image in accordance with the TI method of the present invention. A common gray tone is used to transition between the differing drive schemes. Whenever switching between modes one must be always transition by switching to that common gray level in order to ensure the DC balance has been maintained.

Figure 3:
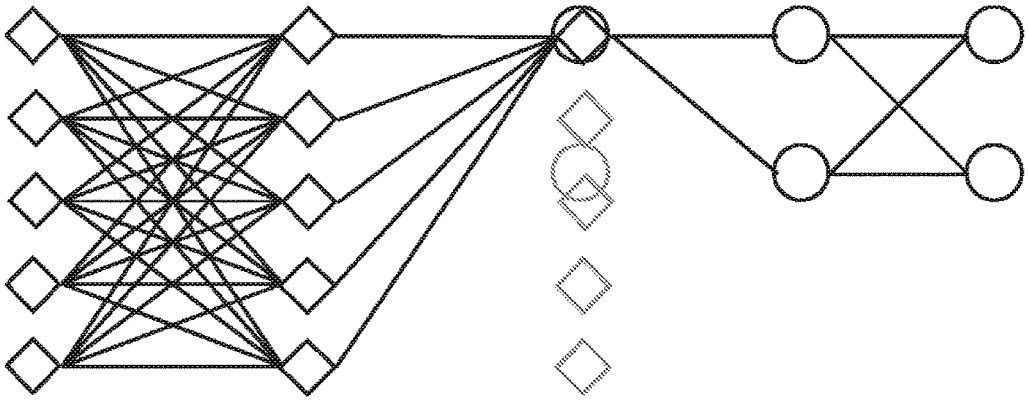
FIG. 3 illustrates schematically a transition from the gray level drive scheme of FIG. 1 to the monochrome drive scheme of FIG. 2 using a transition image method of the present invention.

FIG. 3 illustrates such a TI method being applied during the transition from the drive scheme shown in FIG. 1 to that shown in FIG. 2, which are assumed not to be balanced to each other. The left hand one fourth of FIG. 3 shows a regular gray scale transition using the drive scheme of FIG. 1. Thereafter, the first part of the transition uses the drive scheme of FIG. 1 to drive all pixels of the display to a common gray level (illustrated as the uppermost gray level shown in FIG. 3), while the second part of the transition uses the drive scheme of FIG. 2 to drive the various pixels as required to the two gray levels of the FIG. 2 drive scheme. Thus, the overall length of the transition is equal to the combined lengths of transitions in the two drive schemes. If the optical states of the supposedly common gray level do not match in the two drive schemes some ghosting may result. Finally, a further transition is effected using only the drive scheme of FIG. 2.

It will be appreciated that, although only a single common gray level is shown in FIG. 3, there may be multiple common gray levels between the two drive schemes. In such a case, any one common gray level may be used for the transition image, and the transition image may simply be that caused by driving every pixel of the display to one common gray level. This tends to produce a visually pleasing transition in which one image "melts" into a uniform gray field, from which a different image gradually emerges. However, in such a case it is not necessary that all pixels use the same common gray level; one set of pixels may use one common gray level while a second set of pixels use a different common gray level; so long as the drive controller knows which pixels use which common gray level, the second part of the transition can still be effected using the drive scheme of FIG. 2. For example, two sets of pixels using different gray levels could be arranged in a checkerboard pattern.

Figure 4:
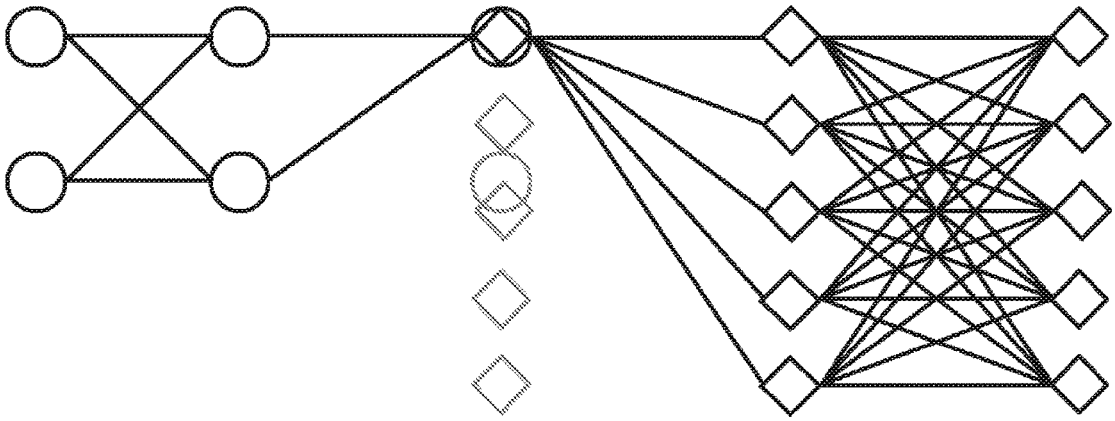
FIG. 4 illustrates schematically a transition which is the reverse of that shown in FIG. 3.

FIG. 4 illustrates a transition which is the reverse of that shown in FIG. 3. The left hand one fourth of FIG. 4 shows a regular monochrome transition using the drive scheme of FIG. 2. Thereafter, the first part of the transition uses the drive scheme of FIG. 2 to drive all pixels of the display to a common gray level (illustrated as the uppermost gray level shown in FIG. 4), while the second part of the transition uses the drive scheme of FIG. 1 to drive the various pixels as required to the six gray levels of the FIG. 1 drive scheme. Thus, the overall length of the transition is again equal to the combined lengths of transitions in the two drive schemes. Finally, a further gray scale transition is effected using only the drive scheme of FIG. 1.

Figure 5:
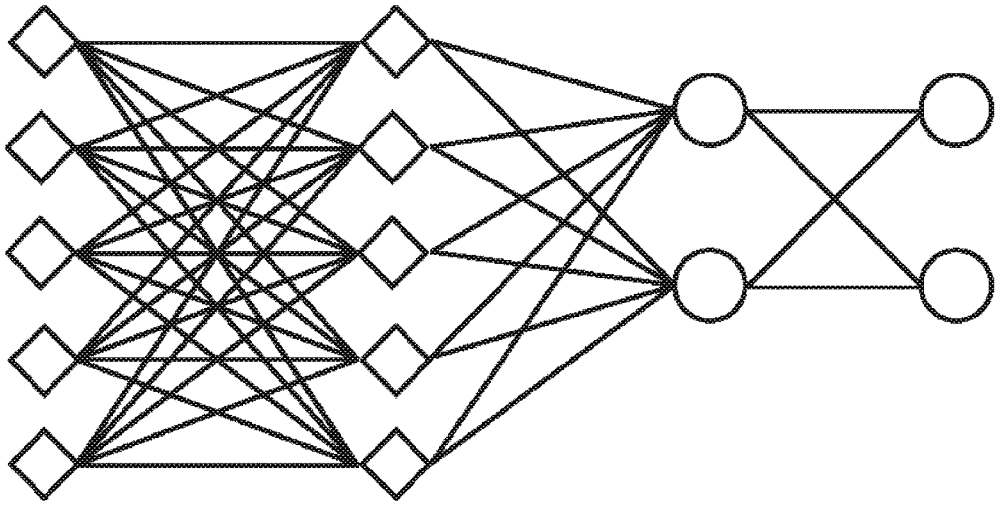
FIG. 5 illustrates schematically a transition from the gray level drive scheme of FIG. 1 to the monochrome drive scheme of FIG. 2 using a transition drive scheme method of the present invention.
Figure 6:
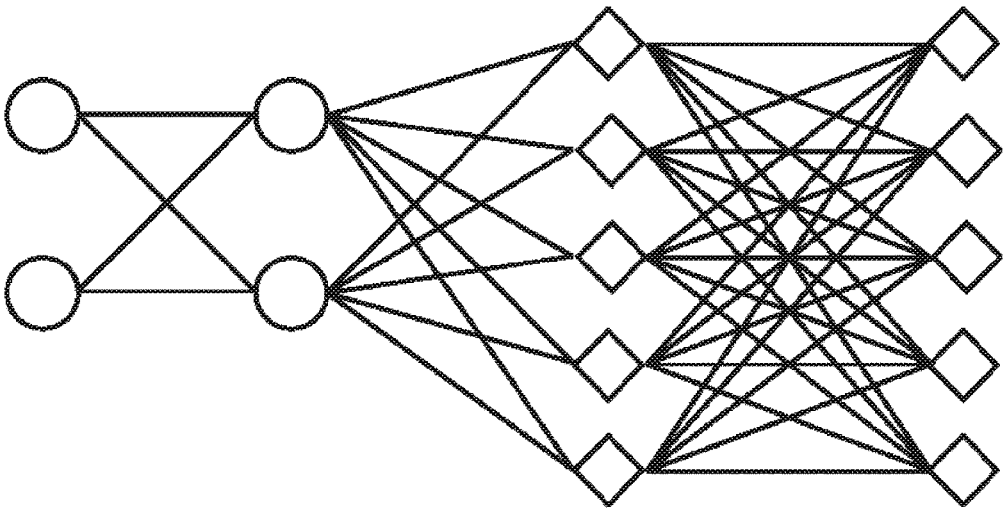
FIG. 6 illustrates schematically a transition which is the reverse of that shown in FIG. 5.

FIGS. 5 and 6 illustrate transitions which are generally similar to those of FIGS. 3 and 4 respectively but which use a transition drive scheme method of the present invention rather than a transition image method. The left hand one third of FIG. 5 shows a regular gray scale transition using the drive scheme of FIG. 1. Thereafter, a transition image drive scheme is invoked to transition directly from the six gray levels of FIG. 1 drive scheme to the two gray levels of the FIG. 2 drive scheme; thus, while the FIG. 1 drive scheme is a 6×6 drive scheme and the FIG. 2 drive scheme is a 2×2 drive scheme, the transition drive scheme is a 6×2 drive scheme. The transition drive scheme can if desired replicate the common gray level approach of FIGS. 3 and 4, but the use of a transition drive scheme rather than a transition image allows more design freedom and hence the transition drive scheme need not pass through a common gray level case. Note that the transition drive scheme is only used for a single transition at any one time, unlike the FIG. 1 and FIG. 2 drive schemes, which will typically be used for numerous successive transitions. The use of a transition drive scheme allows for better optical matching of gray levels and the length of the transition can be reduced below that of the sum of the individual drive schemes, thus providing faster transitions.

FIG. 6 illustrates a transition which is the reverse of that shown in FIG. 5. If the FIG. 2→FIG. 1 transition is the same as the FIG. 1→FIG. 2 transition for the overlapping transitions (which is not always the case) the same transition drive scheme may be used in both directions, but otherwise two discrete transition drive schemes are required.

As already noted, a further aspect of the present invention relates to method of operating electro-optic displays using clearing bars. In one such method, an image is scrolled across the display, and a clearing bar is provided between two portions of the image being scrolled, the clearing bar scrolling across in display in synchronization with the two adjacent portions of the image, the writing of the clearing bar being effected such that every pixel over which the clearing bar passes is rewritten. In another such method, an image is formed on the display and a clearing bar is provided which travels across the image on the display, such that every pixel over which the clearing bar passes is rewritten. These two versions of the method may hereinafter be referred to as the "synchronized clearing bar" and non-synchronized clearing bar" methods respectively.

The "clearing bar" methods are primarily, although not exclusively, to remove, or at least alleviate the ghosting effects which may occur in electro-optic displays when local updating or poorly constructed drive schemes are used. Once situation where such ghosting may occur is scrolling of a display, i.e., the writing on the display of a series of images differing slightly from one another so as to give the impression that an image larger than the display itself (for example, an electronic book, web page or map) is being moved across the display. Such scrolling can leave a smear of ghosting on the display, and this ghosting gets worse the larger the number of successive images displayed.

In a bi-stable display, a black (or other non background color) clearing bar may be added to one or more edges of the onscreen image (in the margins, on the border or in the seams). This clearing bar may be located in pixels that are initially on screen or, if the controller memory retains an image which is larger than the physical image displayed (for example, to speed up scrolling), the clearing bar could also be located in pixels that are in the software memory but not on the screen. When the display image is scrolled (as when reading a long web page) in the image displayed the clearing bar travels across the image synchronously with the movement of the image itself, so that the scrolled image gives the impression of showing two discrete pages rather than a scroll, and the clearing bar forces updates of all pixels across which it travels, reducing the build up of ghosts and similar artifacts as it passes.

The clearing bar could take various forms, some of which might not, at least to a casual user, be recognizable as clearing bars. For example, a clearing bar could be used as a delimiter between contributions in between contributions in a chat or bulletin board application, so that each contribution would scroll across the screen with a clearing bar between each successive pair of contributions clearing screen artifacts as the chat or bulletin board topic progressed. In such an application, there would often be more than one clearing bar on the screen at one time.

A clearing bar could have the form of a simple line perpendicular to the direction of scrolling, and this typically horizontal. However, numerous other forms of clearing bar could be used in the methods of the present invention. For example, a clearing bar could have the form of parallel lines, jagged (saw tooth) lines, diagonal lines, wavy (sinusoidal) lines or broken lines. The clearing bar could also have a form other than lines; for example a clearing bar could have the form of a frame around an image, a grid, that may or may not be visible (the grid could be smaller than the display size or larger than the display size). The clearing bar could also have the form of a series of discrete points across the display strategically placed such that when they are scrolled across the display they force every pixel to switch. such discrete points, while more complicated to implement have the advantage of being self-masking and thus less visible to the user because of being spread out.

The minimum number of pixels in the clearing bar in the direction of scrolling (hereinafter for convenience called the "height" of the clearing bar) should be at least equal to the number of pixels by which the image moves at each scrolling image update. Thus, the clearing bar height could vary dynamically; as the page was scrolled faster the clearing bar height would increase, and as scrolling slowed, the clearing bar height would shrink. However, for simple implementation, it may be most convenient to set the clearing bar height sufficient to allow for the maximum scrolling speed and keep this height constant. Since the clearing bar is unnecessary after scrolling ceases, the clearing bar could be removed when scrolling ceases or remain on the display. The use of a clearing bar will typically be most advantageous when a rapid update drive scheme (DUDS or AUDS) is being used.

When the clearing bar is in the form of a number of spread out points, the "height" of the clearing bar must account for the spacing between the points. The set of each point's location in the direction of scrolling mod the number of pixels which the image moves at each scrolling update should lie in the range of zero to one less than the number of pixels moved at each scrolling update, and this requirement should be satisfied for each parallel line of pixels in the scrolling direction.

The clearing bar need not be of a solid color but could be patterned. A patterned clearing bar might, depending on the drive scheme used, add ghosting noise to the background, thus better disguising image artifacts. The pattern of the clearing bar could change depending upon bar location and time. Artifacts made from using a patterned clearing bar in space could create ghosting in a manner more appealing to the eye. For example one could use a pattern in the form of a corporate logo so that ghosting artifacts left behind appear as a "watermark" of that logo, although if the wrong drive scheme were used, undesirable artifacts could be created. The suitability of an patterned clearing bar may be determined by scrolling the patterned clearing bar with the desired drive scheme across the display using a solid background image, and judging if it the resulting artifacts are desirable or undesirable.

A patterned clearing bar may be particularly useful when the display uses a patterned background. All the same rules would apply; in the simplest case a clearing bar color different from the background color may be chosen. Alternatively, two or more clearing bars of different colors or patterns may be used. A patterned clearing bar can effectively be the same as a spread out points clearing bar, though with the spread out points requirements are modified such that there is there is a point on the clearing bar (of a different color than the specific one being cleared on the background) for each grey tone of the background, such that the set of each clearing point's location in the direction of scrolling mod the number of pixels moved in each scrolling step covers the same range as the patterned background points' location in the direction of scrolling mod the number of pixels moved each scrolling step.

In a display which uses a striped background, a clearing bar could use the same gray tones as the striped background but be out of phase with the background by one block. This could effectively hide the clearing bar to the extent that the clearing bar could be placed in the background between text and behind images. A background textured with random ghosting from a patterned clearing bar can camouflage patterned ghosting from a recognizable image and may produce a display more attractive to some users. Alternatively, the clearing bar could be arranged to leave a ghost of specific pattern, if there is ghosting, such that the ghosting becomes a watermark on the display and an asset.

Although the foregoing discussion of clearing bars has focused on clearing bars that scroll with the image on the display, a clearing bar need not scroll in this manner but instead could be periodically out of synchronization with the scrolling or completely independent of the scrolling; for example, the clearing bar could operate like a windshield wiper or like a conventional video wipe that traversed a display in one direction without the background image moving at all. Multiple non-synchronized clearing bars could be used simultaneously or sequentially to clear various portions of a display. The provision of a non-synchronized clearing bar in one or more parts of the display could be controlled by a display application.

The clearing bar needs not use the same drive scheme as the rest of the display. If a drive scheme having the same or shorter length than that used for the remaining part of the display is used for the clearing bar, implementation is straight forward. If the drive scheme of the clearing bar is longer (as is likely to be the case in practice) not all the pixels in the clearing bar will switch at once but rather a wide subsection of pixels will switch while there are non-switching pixels and regularly switching pixels moving around the clearing bar. The number of non-switching pixels should be large enough so the regularly switching and clearing bar zones do not collide where as the clearing bar needs be wide enough so that no pixels are missed as the clearing bar moves across the screen. The drive scheme used for the clearing bar could be a selected one of the drive schemes used for the remainder of the display or could be a drive scheme specifically tuned to the needs of a clearing bar. If multiple clearing bars are used, they need not all use the same drive scheme.

From the foregoing, it will be seen that the clearing bar methods of the present invention can readily be incorporated into many types of electro-optic displays and provide methods of page clearing which are less obtrusive visually than other methods of page clearing. Several variants of clearing bar methods, both synchronized and non-synchronized could be incorporated into a specific display, so that either software or the user could select the method to be used depending upon factors such as user perception of acceptability, or the specific program being run on the display.

It will be apparent to those skilled in the art that numerous changes and modifications can be made in the specific embodiments of the invention described above without departing from the scope of the invention. Accordingly, the whole of the foregoing description is to be interpreted in an illustrative and not in a limitative sense.

The invention claimed is:

1. A method of operating an electro-optic display using first and second drive schemes differing from each other and at least one transition drive scheme different from both the first and second drive schemes, the method comprising, in this order:

driving the display to a first image using a first drive scheme;

driving the display to a second image, different from the first image, using a first transition drive scheme;

driving the display to a third image, different from the second image using a second drive scheme;

driving the display to a fourth image, different from the third image, using a second transition drive scheme; and driving the display to a fifth image, different from both the third and fourth images, using the first drive scheme;

wherein the first transition drive scheme is different from the second transition drive scheme.

2. The method of claim 1, wherein the first drive scheme is a gray scale drive scheme capable of driving the display to at least four gray levels.

3. The method according to claim 2, wherein the first drive scheme is a gray scale drive scheme capable of driving the display to at least eight gray levels.

4. The method of claim 1, wherein the first and second drive schemes have different numbers of gray levels.

5. The method of claim 1, wherein the second drive scheme is an application update drive scheme having fewer gray levels than the first drive scheme and a maximum update time less than the length of a saturation pulse of the display.

6. The method of claim 1, wherein the electro-optic display is bistable.

7. The method of claim 1, wherein the electro-optic display comprises a rotating bichromal member or electrochromic material.

8. The method of claim 1, wherein the electro-optic display comprises an electrophoretic material comprising a plurality of electrically charged particles disposed in a fluid and capable of moving through the fluid under the influence of an electric field.

9. The method of claim 8, wherein the electrically charged particles and the fluid are confined within a plurality of capsules or microcells.

10. The method of claim 8, wherein the electrically charged particles and the fluid are present as a plurality of discrete droplets surrounded by a continuous phase comprising a polymeric material.

11. The method of claim 8, wherein the fluid is gaseous.

12. The method of claim 1, wherein the at least one transition drive scheme includes a transition image.

13. The method of claim 12, wherein the transition image comprises a single tone applied to all the pixels of the display.

14. The method of claim 1, wherein the display is driven successively to a plurality of transition images before being driven to the second image or before being driven to the third image.

* * * * *